United States Patent [19]

Allen

[11] Patent Number: 4,820,914

[45] Date of Patent: Apr. 11, 1989

[54] GAIN CONTROL OF PHOTOMULTIPLIER TUBES USED IN DETECTING DIFFERENTIAL ABSORPTION LIDAR RETURNS

[75] Inventor: Robert J. Allen, Tabb, Va.

[73] Assignee: Vigyan Research Associates, Inc., Hampton, Va.

[21] Appl. No.: 146,093

[22] Filed: Jan. 20, 1988

[51] Int. Cl.[4] ..... H01J 40/14

[52] U.S. Cl. ..... 250/207; 313/533

[58] Field of Search ..... 250/207, 213 VT; 313/533, 534–536; 315/169.1

[56] References Cited

U.S. PATENT DOCUMENTS

| | | | |
|---|---|---|---|
| 3,076,896 | 2/1963 | Smith | 250/207 |
| 3,321,629 | 5/1967 | Hobrough | 250/207 |
| 3,435,233 | 3/1969 | Farnsworth | 250/207 |
| 3,821,546 | 6/1974 | McClenahan | 250/207 |
| 3,997,779 | 12/1976 | Rabl | 250/207 |
| 4,195,931 | 4/1980 | Hara | 356/346 |
| 4,409,474 | 10/1983 | Howarth | 250/207 |
| 4,661,693 | 4/1987 | Masanoba | 313/533 |

FOREIGN PATENT DOCUMENTS

| | | | |
|---|---|---|---|
| 1069031 | 1/1984 | U.S.S.R. | 250/207 |

OTHER PUBLICATIONS

Allen, R. J. and W. E. Evans, The Review of Scientific Instruments, "Laser Radar (LIDAR) for Mapping Aerosol Structures," vol. 43, No. 10, Oct. 1972, pp. 1422–1432.

Barrick, John D. W. "Gating Characteristics of Photomultiplier Tubes for LIDAR Applications." NASA Technical Memorandum 87699, Aug. 1986.

*Primary Examiner*—David C. Nelms
*Assistant Examiner*—Michael Messinger
*Attorney, Agent, or Firm*—William H. King

[57] ABSTRACT

A technique for controlling the gain of a photomultiplier tube (PMT) 20. A voltage divider (resistors 45–49 in FIG. 1 and zener diodes 60–65 in FIG. 3) is used to control the potentials on dynodes 5, 7, and 9 of PMT 20. Transistor switches 53 and 58 provide the control of the voltage divider in FIG. 1 and photodiodes 66, 67 and 70 provide the control in FIG. 3. The gain control of PMT 20 is in the range from 100% to less than 0.001% (100,000 to 1).

16 Claims, 4 Drawing Sheets

GAIN CONTROL OF PHOTOMULTIPLIER TUBES USED IN DETECTING DIFFERENTIAL ABSORPTION LIDAR RETURNS

ORIGIN OF THE INVENTION

The invention described herein was made in the performance of work under NASA Contract NAS1-17919. In accordance with 305 USC 202, the contractor has elected to retain title; however, the Government has certain rights in this invention. LIDAR stands for Light Detection And Ranging.

BACKGROUND OF THE INVENTION

The invention relates generally to gain control of photomultiplier tubes (PMTs) and more specifically concerns gain control of PMTs used in detecting differential absorption LIDAR returns.

The purpose of the invention is to change the gains of a PMT to accommodate differential laser signal returns produced by pulsed lasers with temporal separations of a few hundred microseconds operating at wavelengths ON and OFF the absorption lines of various trace gases. The gain of a PMT must be low during LASE to minimize saturation, increase to its maximum when the ON-LINE return is being received, and increase to a value below maximum a few hundred microseconds later when the stronger OFF-LINE return is being received.

The prior art involves designing the high voltage (−1000 to 3000 V) PMT divider network so that the focusing electrode voltage is near that of the cathode for minimum gain, and supplying a capacitive coupled externally produced 300 to 800 volt pulse-pair signal to drive the focusing electrode voltage close to that of the first dynode in order to obtain the required ON and OFF-LINE gains.

An alternative technique is to tie the odd-numbered dynodes to a voltage divider, offset the even-numbered dynodes about 30 volts from nominal divider voltages in order to reduce the gain, and use a 0 to −30 volt pulse-pair signal coupled through capacitors in order to drive all even-numbered dynodes back to their required ON and OFF-LINE gains.

Other techniques do not provide a means of setting the ON-LINE gain different from the OFF-LINE gain, and/or are not satisfactory for differential absorption type LIDAR returns separated by a few hundred microseconds.

A major disadvantage of the prior art is the requirement to capacitor-couple the externally produced pulse-pair control signals into the high-impedance high-voltage PMT divider network. The network does not completely recover during the few hundred microseconds between ON and OFF-LINE returns resulting in reduced accuracy of the differential measurements.

Other disadvantages are the bulky adjustable power supplies, high-voltage switching networks requiring increased maintenance costs and time, and the increased logic circuitry to produce two different amplitude PMT gain control pulses.

An object of this invention is to sequentially control the flow of electrons within PMTs using the focus electrodes, individual dynodes, and/or combinations of dynodes in order to change the gain to accommodate differential laser signal returns produced by pulsed lasers with temporal separations of a few hundred microseconds operating at wavelengths ON and OFF the absorption line of various trace gases.

Another object of this invention is to provide a PMT gain control that eliminates the requirement of capacitor coupling thereby providing increased accuracy of differential measurements.

A further object of this invention is to provide a PMT gain control which does not require bulky external adjustable power supplies with high-voltage switching.

Yet another object of this invention is to provide various preselect PMT gains using a control method that does not require different amplitude control signals.

A still further object of this invention is to provide a PMT gain control that can utilize fiber optic control and thereby minimize electromagnetic interference effects and reduce switching transients.

Other objects and advantages of this invention will become apparent hereinafter in the specification and drawings.

SUMMARY OF THE INVENTION

In this invention zener diodes are connected between the dynodes 4 and 6, 6 and 8, and 8 and 10 of a PMT for maintaining dynodes 6, 8 and 10 at their normal operating potentials. A voltage divider is connected to dynodes 4, 5, 7 and 9 for maintaining dynodes 5, 7 and 9 at their normal operating potentials. Switching means are provided for altering, in response to signals, the voltage divider to apply different potentials to dynodes 5, 7 and 9 to thereby change the gain of the PMT.

In one embodiment of the invention the voltage divider is a group of resistors connected in series between dynode 4 and ground. The switching means are two transistor or other switches with each connected in series with a different variable resistor and the combination connected across the resistor in the group connected to ground. Consequently, with both switches off the PMT has minimum gain and when either switch is pulsed on the gain of the PMT is increased to a discrete level depending on the setting of the associated variable resistor. In the present application one of the variable resistors is set to zero or near zero so that when the associated transistor is switched on the gain of the PMT is maximum or near maximum.

In the other embodiment of the invention the voltage divider is a group of zener diodes connected in series between dynode 4 and dynode 10 with two zener diodes connected in series between dynode 4 and dynode 5, and with two zener diodes connected in series between dynode 9 and dynode 10. The switching means are two photodiodes with the first connected in parallel with the second zener diode in said group and with the second connected in parallel with the last zener diode in said group. With the first photodiode pulsed on and with the second photodiode off the PMT has maximum gain and with the first photodiode off and with the second photodiode pulsed on, the PMT has minimum gain. This embodiment also includes a third photodiode for controlling the potential on the focusing electrode of the PMT and thereby controlling the gain of the PMT over a greater range. The required higher gain is realized by turning this third photodiode on just prior to receiving the on-line return.

DETAILED DESCRIPTION OF THE INVENTION

Figure 1:
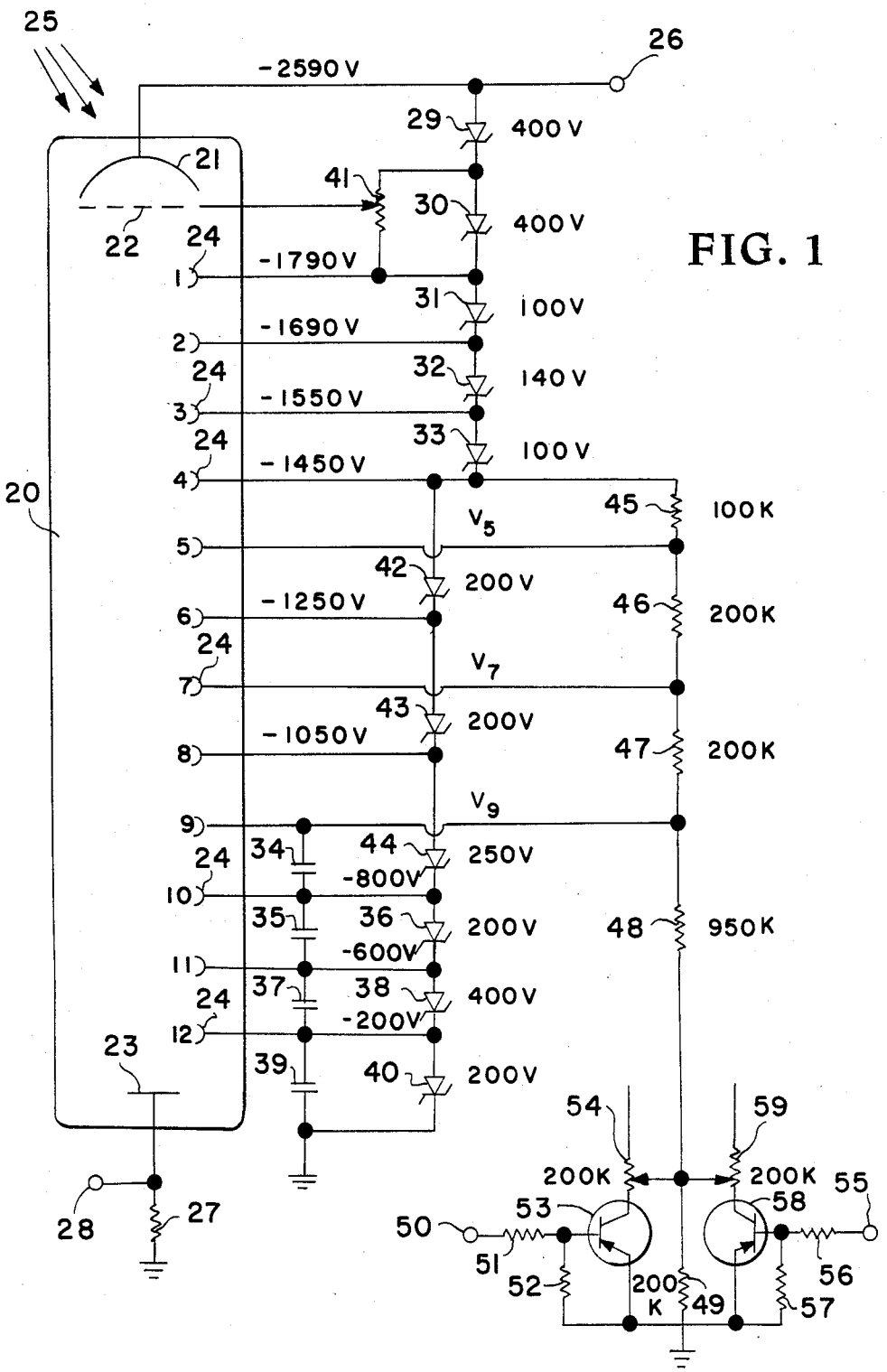
FIG. 1 is a schematic drawing of one embodiment of the invention.

Turning now to the embodiments of the invention selected for illustration in the drawings, the number 20 in FIG. 1 designates a photomultiplier tube (PMT). For this specific embodiment of the invention an RCA 8850 or RCA C31000M has been used. PMT 20 includes a cathode 21, a focus electrode 22, a plate 23 and twelve dynodes 24 numbered 1 through 12. The PMT 20 is for measuring the light rays 25. A negative voltage (−2590 V) is applied by circuitry not shown through an input terminal 26 to the cathode 21. The plate 23 is connected through a resistor 27 to ground. The output of the PMT is at an output terminal 28 and is the voltage drop developed across resistor 27. A zener diode 29 and a zener diode 30 are connected in series between the input and the dynode numbered 1, a zener diode 31 is connected between the dynodes numbered 1 and 2, a zener diode 32 is connected between the dynodes numbered 2 and 3, and a zener diode 33 is connected between the dynodes numbered 3 and 4. A capacitor 34 is connected between the dynodes numbered and 9 and 10, a capacitor 35 and a zener diode 36 are connected in parallel between the dynodes numbered 10 and 11, a capacitor 37 and a zener diode 38 are connected in parallel between the dynodes numbered 11 and 12, and a capacitor 39 and a zener diode 40 are connected in parallel between the dynode numbered 12 and ground. A potentiometer 41 is connected between the junction of zener diodes 29 and 30, and the dynode numbered 1 with its slider connected to the focus electrode 22 for controlling the potential on the focus electrode. The circuitry described above which can be different from that described is considered to be the seating for the invention. Even though this circuitry is essential to the operation of the invention, it is not considered to be a part of the invention.

The invention, which is the following described circuitry, includes a zener diode 42 connected between the dynodes numbered 4 and 6, a zener diode 43 connected between the dynodes numbered 6 and 8, and a zener diode 44 connected between the dynodes numbered 8 and 10. The purpose of zener diodes 42, 43 and 44 is to hold the potentials on dynodes numbered 6, 8 and 10 at fixed potentials necessary to provide voltage references with gain changes of the PMT 20.

A voltage divider, consisting of resistors 45, 46, 47, 48 and 49 connected in series, is connected between the dynode numbered 4 and ground. Resistor 45 is connected to the diode numbered 4, the junction of resistors 45 and 46 is connected to the dynode numbered 5, the junction of resistors 46 and 47 is connected to the dynode numbered 7, and the junction of the resistors 47 and 48 is connected to the dynode numbered 9. Note that for the values of the potentials, zener diodes and resistors shown, if resistor 49 is bypassed, that is, if resistor 48 is connected directly to ground, the potentials on dynodes numbered 5, 7, and 9 ($V_5$, $V_7$ and $V_9$) will be −1350 V, −1150 V and −950 V, respectively. Consequently, the potential differences between the dynode pairs (4,5), (5,6), (6,7), (7,8) and (8,9) will each be 100 V. These are the potential differences that are necessary for the maximum gain of the PMT 20. If resistor 49 is not bypassed the potentials $V_5$, $V_7$ and $V_9$ will be −1362.1 V, −1186.4 V and −1010.6 V, respectively. This will provide a gain of the PMT 20 equal to approximately 0.47% of maximum gain. This is the low gain utilized during LASE (see FIG. 2) in order to minimize saturation of PMT 20 caused by breakthrough or strong reflections at the time of the outputted laser beam.

A first control switch means including an input terminal 50, a voltage divider (resistors 51 and 52), a high speed transistor switch 53 and a potentiometer 54 is connected between the junction of resistors 48 and 49, and ground as shown. Potentiometer 54 is connected such that it acts as a variable resistor. This first control switch means is the ON-LINE control for the described application of this invention. Note that when this switch means is on and potentiometer 54 is set to provide a zero or near zero resistance the gain of the PMT will be maximum or approximately maximum.

A second control switch means including an input terminal 55, a voltage divider (resistors 56 and 57), a high speed transistor switch 58 and a potentiometer 59 is connected between the junction of resistors 48 and 49, and ground as shown. This second control switch means is the OFF-LINE control for the described application of this invention. Note that when this switch means is on and potentiometer 59 is set to provide a non-zero resistance, the gain the PMT 20 will be less than maximum. For the described application potentiometer 59 is set to provide a 50 to 100% gain of the PMT 20.

Figure 2:
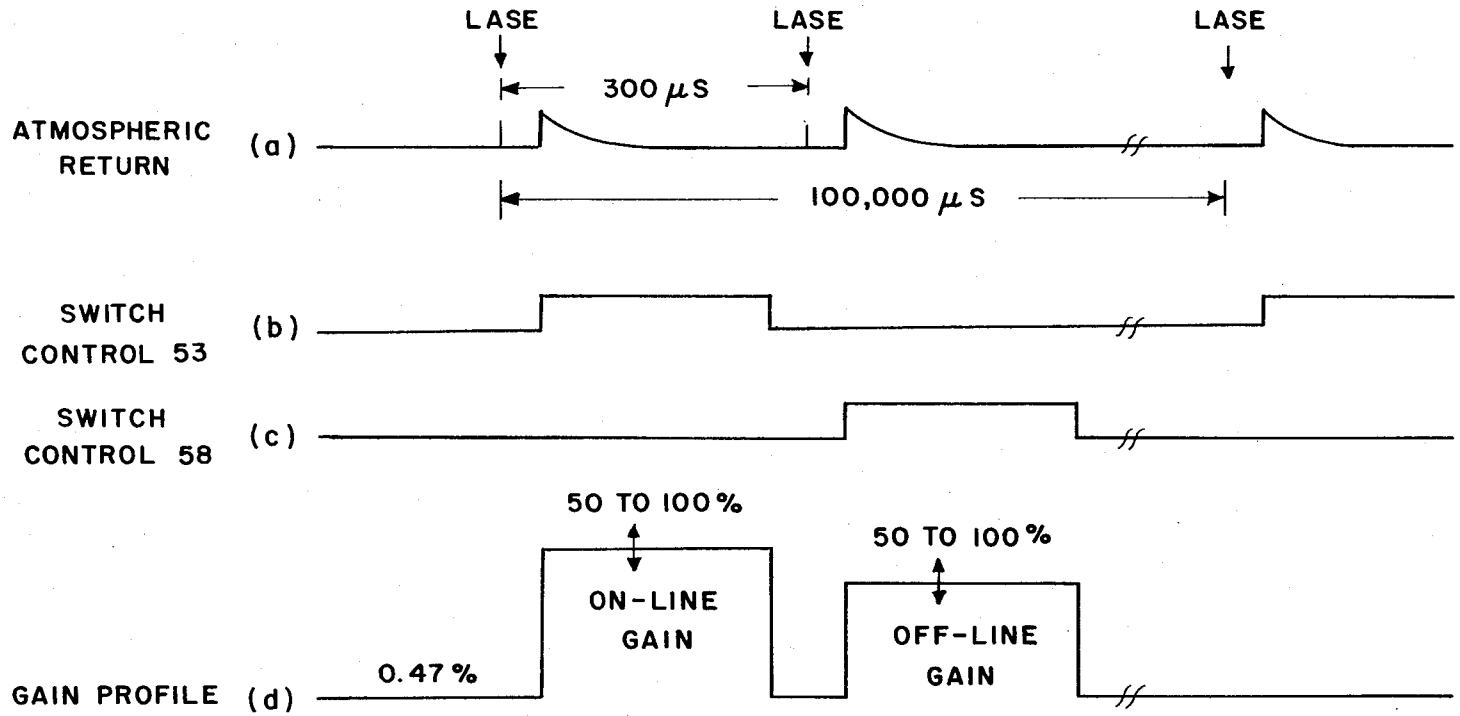
FIG. 2 is a gain control timing diagram for the embodiment of the invention in FIG. 1.

FIG. 2 is a gain control timing diagram of PMT 20 for the embodiment of the invention shown in FIG. 1. FIG. 2(*a*) is a timing diagram of the atmospheric return, FIG. 2(*b*) is a timing diagram including the time when the ON-LINE switch 53 is turned on, FIG. 2(*c*) is a timing diagram including the time when OFF-LINE switch 58 is turned on and FIG. 2(*d*) is a timing diagram showing the gain profile of the PMT 20. PMT 20 has a gain of 0.47% of maximum during LASE when both switch 53 and switch 58 are turned off, has a preset gain of 50 to 100% (usually set at 100%) of maximum during ON-LINE when switch 53 is on and switch 58 is off, and has a preset gain of 50 to 100% (usually set less than maximum) of maximum during OFF-LINE when switch 53 is off and switch 58 is on.

Figure 3:
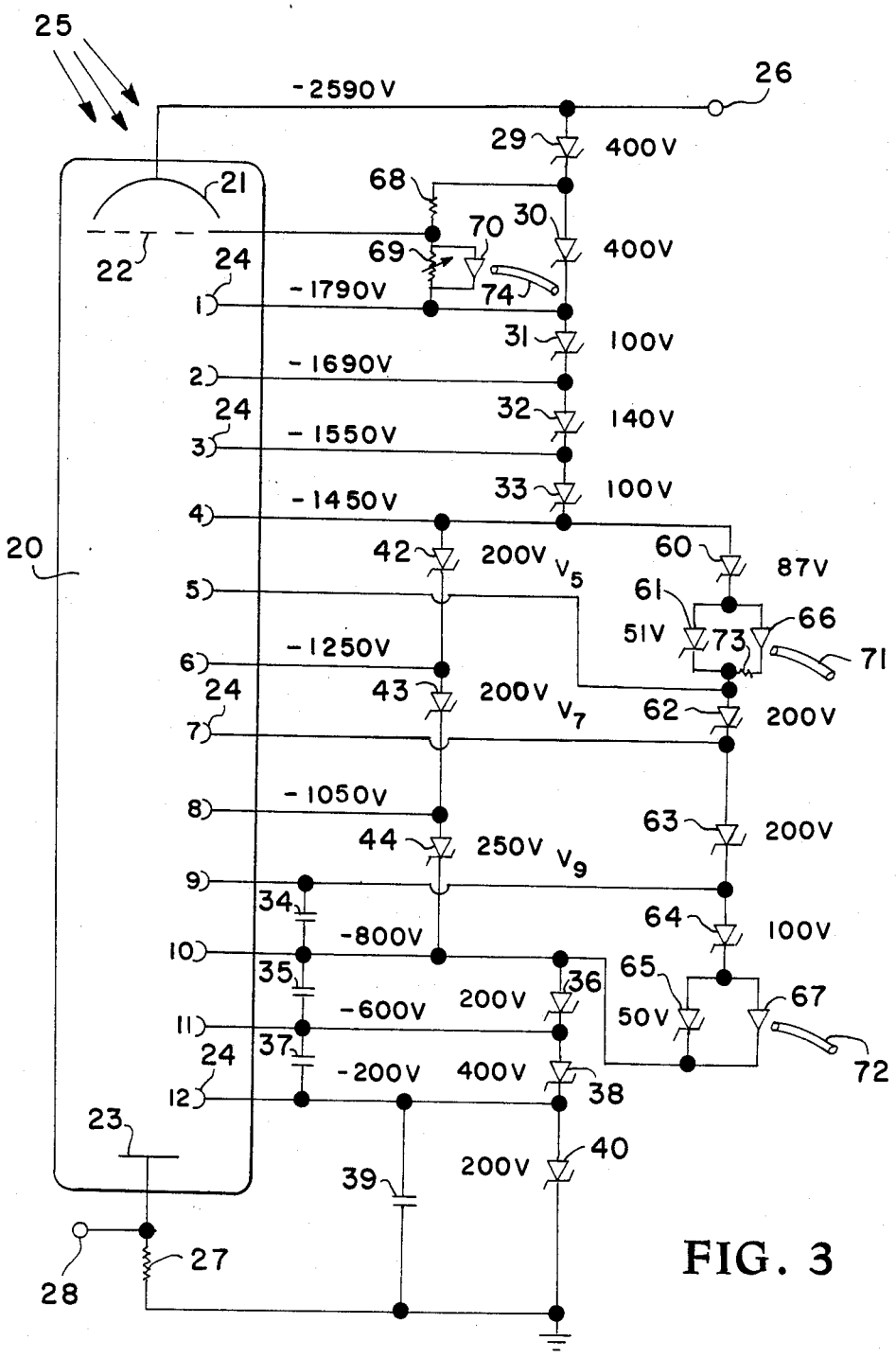
FIG. 3 is a schematic drawing of a second embodiment of the invention.

The embodiment of the invention shown in FIG. 3 is substantially the same as the embodiment in FIG. 1 except for the voltage divider and the means for controlling the focus electrode 22. The voltage divider is a group of zener diodes 60 , 61, 62, 63, 64 and 65 connected in series between the dynode numbered 4 and the dynode numbered 10. The junction of zener diodes 61 and 62 is connected to the dynode numbered 5, the junction of zener diodes 62 and 63 is connected to the dynode numbered 7, and the junction of zener diodes 63 and 64 is connected to the dynode numbered 9. High-voltage modified pin photodiodes 66 and 67 are connected in parallel with zener diodes 61 and 65, respectively. These high-voltage photodiodes illuminated via fiber optics cables 71 and 72 act as light-controlled variable resistors. The photodiode 66 and small resistor 73, for the example shown, provides a 13 V drop when it is on and the photodiode 67 provides a 12 V drop when it is on. The control light signals to photodiodes 66 and 67 are always opposite: light on photodiode 66 and light off to photodiode 67, and visa versa. Consequently, when photodiode 66 is on and photodiode 67 is off the potentials $V_5$, $V_7$ and $V_9$ will be −1350 V, −1150 V, and −950 V, respectively, providing a high gain for PMT 20. When photodiode 66 is off and photodiode 67 is on the potentials $V_5$, $V_7$ and $V_9$ will be −1312 V, −1112 V and −912 V, respectively, providing a low gain for PMT 20.

The means for controlling the focus electrode 22 is a resistor 68 and a variable resistor 69 connected in series between the junction of zener diodes 29 and 30, and the dynode numbered 1. The focus electrode 22 is connected to the junction of resistors 68 and 69. A high-voltage photodiode 70 like photodiodes 66 and 67 illuminated via a fiber optics cable 74, is connected in parallel with variable resistor 69. Photodiode 70 controls the percentage of the dynode numbered 1 to cathode voltage and is increased to the On-LINE (maximum or >95%) gain just prior to switching photodiodes 66 and 67. This will minimize switching transients. The OFF-LINE gain is preset to between 48% and 95% of maximum by adjusting the variable resistor 69 when photodiodes 70 and 67 are off.

The operation of photodiodes 66, 67 and 70 for detecting a LIDAR return are summarized as follows:

| CONDITION | Photo-diode # | Light | GAIN (% of Maximum) |
|---|---|---|---|
| 1. Between and during LASE | 66 | OFF | Maximum off (less than 0.001%) |
| | 67 | ON | |
| | 70 | OFF | |
| 2. Immediately following ON-LINE LASE | 66 | OFF | Increases to less than 1 |
| | 67 | ON | |
| | 70 | ON | |
| 3. ON-LINE gain | 66 | ON | Maximum ON ≃100% |
| | 67 | OFF | |
| | 70 | ON | |
| 4. OFF-LINE gain | 66 | ON | Less than maximum (50 to 100%) |
| | 67 | OFF | |
| | 70 | OFF | |

Figure 4:
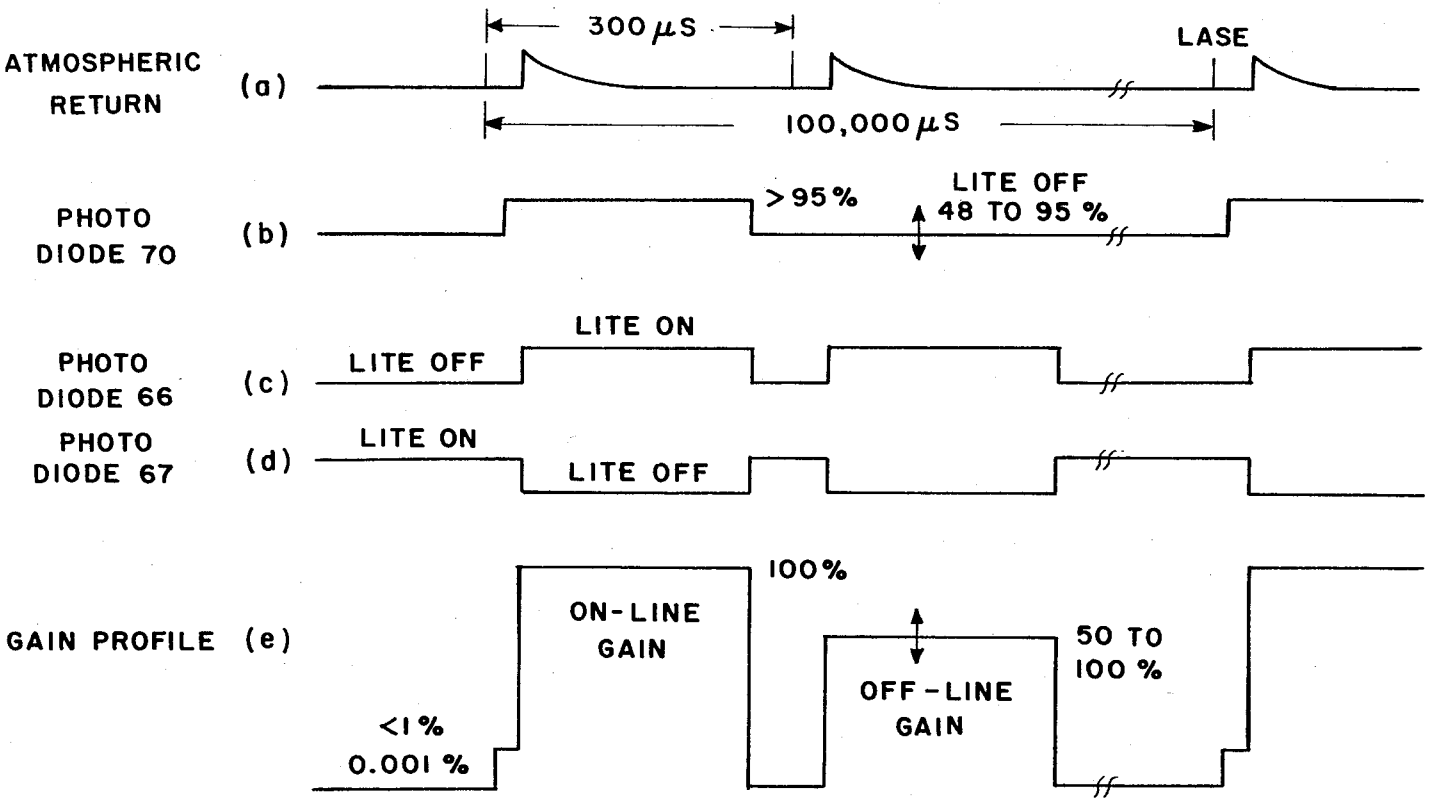
FIG. 4 is a gain control timing diagram for the embodiment of the invention in FIG. 3.

FIG. 4 is a gain control timing diagram of PMT 20 for the embodiment of the invention shown in FIG. 3. FIG. 4(*a*) is a timing diagram of the atmospheric return, FIGS. 4(*b*), (*c*), (*d*) are timing diagrams including the times when photodiodes 70, 66 and 67, respectively, are turned on and off and FIG. 4(*e*) is a timing diagram of the gain profile.

The means for generating the control signals for the embodiments of the invention in FIGS. 1 and 3 is not considered to be a part of the invention and are therefore not disclosed. However, the means for generating these control signals will be obvious to one skilled in the art.

The advantages of this invention are that capacitor coupling is eliminated thereby providing increased accuracy of differential measurements, bulky external adjustable power supplies with high-voltage switching are eliminated, logic required to provide different amplitude control signals is eliminated, and fiber optic control (FIG. 3) can be used to minimize electromagnetic interference effects and reduce switching transients.

Specific embodiments of the invention have been disclosed. Obviously, many different embodiments could be used without departing from this invention. For example, different PMTs having different numbers of dynodes and different sized resistors, zener diodes, voltages and photodiodes could be used. Also, the voltage dividers are shown as controlling the potentials on three dynodes; a different number of dynodes could be controlled. In addition, a number of transistor switches other than two could be used in other applications of the invention. Transistors or resistors could be used instead of some of the zener diodes. Both transistor switches in FIG. 1 are duplicate. Either one could be used as ON-LINE or OFF-LINE control with different potentiometer settings. Transistors can be used in place of photodiode switches in FIG. 3.

What is claimed is:

1. A gain control of a photomultiplier tube (PMT) used in detecting differential absorption LIDAR returns in which the potentials on the dynodes of the PMT are controlled by a network of electrical elements comprising:

means connected between a dynode numbered n and dynode n+2, between dynode n+2 and dynode n+4, and between dynode n+4 and dynode n+6 for maintaining the dynodes n+2, n+4 and n+6 at their normal operating potentials providing a fixed voltage reference;

a voltage divider means connected to the dynodes numbered n, n+1, n+3 and n+5 for maintaining the dynodes n+1, n+3 and n+5 at their normal operating potentials for maximum gain of the PMT; and switching means for altering said voltage divider means to change the potentials to dynodes n+1, n+3 and n+5 to thereby reduce the gain of said PMT to different discrete levels.

2. A gain control according to claim 1 wherein said voltage divider means is a group of resistors connected in series between said dynode numbered n and ground with junctions of the resistors connected to dynodes n+1, n+3 and n+5.

3. A gain control according to claim 2 wherein said switching means is a first connected in parallel with the resistor of said group of resistors that is connected to ground and a second switch connected in series with a variable resistor with the two connected in parallel with the resistor of said group of resistors that is connected to ground whereby with both the first and second switches off the PMT has minimum gain, with the first switch on and the second switch off the PMT has maximum gain and with the first switch off and the second switch on the PMT has a gain between minimum and maximum depending on the setting of the variable resistor.

4. A gain control according to claim 3 including a second variable resistor connected in series with said first switch whereby when said first switch is on the gain of the PMT can be adjusted to a level below maximum.

5. A gain control according to claim 2 wherein said switching means is a switch connected in parallel with one of said group of resistors.

6. A gain control according to claim 1 wherein said voltage divider means is a group of zener diodes connected in series between dynode n and dynode n+6 with junctions of the zener diodes connected to dynodes n+1, n+3 and n+5.

7. A gain control according to claim 6 wherein the first two zener diodes of said group of zener diodes are connected between dynodes n and n+1, and the last two zener diodes of said group of zener diodes are connected between dynodes n+5 and n+6 and wherein said switching means includes a first switch connected in parallel with one of the said first two zener diodes and a second switch connected in parallel with one of the said last two zener diodes whereby whenever the first switch is on and the second switch is off the PMT has a high gain and whenever the first switch is off and the second switch is on the PMT has a low gain.

8. A gain control according to claim 7 including means which includes a third switch for controlling the potential difference between the first dynode and the focus electrode of the PMT to thereby control the gain of the PMT.

9. A gain control according to claim 8 wherein said first, second and third switches are high-voltage pin diodes modified to become photodiodes.

10. A gain control of a photomultiplier tube (PMT) to discrete levels where the potentials on the dynodes of the PMT are controlled by a network of electrical elements comprising:

means for connecting in succession a dynode numbered n and dynodes $n+2i$, where $i=1, 2, \ldots, m$ for maintaining these dynodes at their normal operating potentials;

voltage divider means connected to dynodes n and $n+2i-1$ for maintaining these dynodes at their normal operating potentials; and switching means for altering said voltage divider means to change the potentials on said dynodes $n+2i-1$ to thereby change the gain of said PMT to different discrete levels.

11. A gain control according to claim 10 wherein said voltage divider means is a group of resistors connected in series between said dynode n and ground with junctions of the resistors connected to dynodes $n+2i-1$.

12. A gain control according to claim 11 wherein said switching means includes a number of switches with each connected in series with a different variable resistor and with each combination connected in parallel with a resistor in said group of resistors whereby all of said numbers of switches off the PMT has minimum gain and the turning on of either of said number of switches will increase the gain of the PMT to a discrete level depending on the setting of the corresponding variable resistor.

13. A gain control according to claim 10 wherein said voltage divider means is a group of zener diodes connected in series between dynode n and a dynode $n+2m$ to which the last of said zener diodes is connected.

14. A gain control according to claim 13 wherein the first two zener diodes of said group of zener diodes are connected between dynodes n and $n+1$ and the last two zener diodes of said group of zener diodes are connected between dynodes $n+2m-1$ and $n+2m$ and wherein said switching means includes a first switch connected in parallel with one of the said first two zener diodes and a second switch connected in parallel with one of the said last two zener diodes whereby whenever the first switch is on and the second switch is off the PMT has a high gain and whenever the first switch is off and the second switch is on the PMT has a low gain.

15. A gain control according to claim 14 including means which includes a third switch for controlling the potential difference between the first dynode and the focus electrode of the PMT to thereby control the gain of the PMT whereby the ratio of on-to-off gain control can be increased using both focus electrode and dynode switching.

16. A gain control according to claim 15 wherein said first, second and third switches are photodiodes.

* * * * *